US005896890A

United States Patent [19]

Bourkel et al.

[11] Patent Number: 5,896,890

[45] Date of Patent: Apr. 27, 1999

[54] PILOT-OPERATED SERVO-VALVE

[75] Inventors: Arséne Bourkel, Belvaux, Luxembourg; Bernd Lanfermann, Rees, Germany; Karl Tratberger, Duisburg, Germany; Karl-Heinz Post, Kaarst, Germany

[73] Assignee: Hydrolux S.a r.l., Luxembourg

[21] Appl. No.: 08/817,302

[22] PCT Filed: Nov. 13, 1995

[86] PCT No.: PCT/EP95/04454

§ 371 Date: Sep. 16, 1997

§ 102(e) Date: Sep. 16, 1997

[87] PCT Pub. No.: WO96/15373

PCT Pub. Date: May 23, 1996

[30] Foreign Application Priority Data

Nov. 6, 1994 [LU] Luxembourg ..... 88558

[51] Int. Cl.[6] ..... F15B 13/043

[52] U.S. Cl. ..... 137/625.63; 137/625.64

[58] Field of Search ..... 137/625.63, 625.64

[56] References Cited

U.S. PATENT DOCUMENTS 5,445,188 8/1995 Bourkel et al. ..... 137/625.64

*Primary Examiner*—Gerald A. Michalsky

*Attorney, Agent, or Firm*—Gary M. Nath; Nath & Associates

[57] ABSTRACT

A pilot controlled servo-valve has four main flow connections, an axially sliding main control piston with four control edges and a front restoring spring that defines a spring-centered middle position of the main control piston. A control sleeve has ring shaped openings for the first, second and third main flow connections and a front opening for the fourth main flow connection. A first front face of the main control piston is axially opposed to the front opening. A pressure compensation surface is formed by the second front face of the main control piston in a spring chamber. The main control piston applies the pressure in the fourth main flow connection on said pressure compensating surface through a pressure relief channel. A traverse bore connects said pressure relief channel to an auxiliary connection chamber connected to the third main flow connection by the forth control edge. This valve may be space-savingly integrated in a hydraulic block and has a clearly defined middle position, as well as a remarkable dynamic performance.

7 Claims, 2 Drawing Sheets

PILOT-OPERATED SERVO-VALVE

BACKGROUND OF THE INVENTION

The invention generally relates to hydraulic servo valves and specifically to a pilot-operated servo valve with four main- stream ports for mounting into a control block.

Pilot-operated electrohydraulic servo valves of twin- and multi-stage design with four main-stream ports are used as 4-way valves to control the position, speed and force in cylinders for linear movements or position, rotational speed and torque in hydraulic motors for rotary movements.

They are conventionally designed as plate-stack valves, i.e. they have a prismatic valve housing for mounting on a connection surface of a hydraulic block. The four main-stream ports of the valve lie in a planar connection surface of the valve housing, and their openings into the control bore of a main control piston are designed symmetrically. Control chambers are arranged in end caps flange-mounted on the valve housing on both sides. These control chambers are connected via control bores to a pilot servo valve. The symmetrical main control piston is hydraulically actuated by applying pressure to its two end surfaces in the end control chambers. Pilot-operated 4-way servo valves with valve housing for mounting on a connection surface of a hydraulic block are highly space-consuming and require complicated bores in the hydraulic block for the four main-stream ports.

Prior art pilot-operated 4-way servo valves have a spring-centered rest position. In most cases the main control piston is centered via two opposite return springs arranged in the end control chambers and acting against each other.

A pilot-operated 4-way proportional valve with one-sided spring centering is described in the German hydraulic handbook "Der Hydraulik Trainer Band 2", published by Mannesmann Rexroth GmbH, DE-8770 Lohr am Main (Germany), 3rd edition 1989, page 31, FIG. 33. The disclosed valve is conceived for mounting on a connection surface of a hydraulic block. The control chambers of the valve are disposed in end caps, which are flange-mounted on opposite sides of a valve body. DE-A-4011908 discloses a 5-way valve with one-sided spring centering and an actuating piston disposed at the opposite end of the main control piston. This valve too is conceived for mounting on a connection surface of a hydraulic block.

SUMMARY OF THE INVENTION

The invention provides a pilot-operated servo valve which can be integrated in a space-saving manner in a hydraulic block, has a clearly defined center position and good dynamic properties.

The pilot-operated 4-way servo valve according to the invention has a control sleeve, which can be mounted directly in a stepped bore in a hydraulic block. This control sleeve has axially spaced lateral openings for first, second and third lateral working connections in the hydraulic block. The hydraulic block into which the control sleeve is inserted has three lateral block bores for the first, second and third main-stream ports. The opening into the control sleeve for the fourth main-stream port is arranged on the front end of the control sleeve in such a way that this fourth main-stream port terminates axially in the control sleeve. This control sleeve provides great freedom with regard to the arrangement of the block bore for the fourth main-stream port. The latter can be disposed, for example, in a direct axial extension of the stepped bore for the control sleeve. Furthermore, with the pilot-operated 4-way servo valve according to the invention, the need for bridgings in the hydraulic block between individual main-stream ports is eliminated. The servo valve according to the invention thus affords a far more compact construction of the control blocks than is possible with conventional servo valves. Even in more complex hydraulic control systems the servo valve according to the invention can be integrated together with various additional valves, e.g. two-way built-in valves, in a space-saving manner into a hydraulic block. Direct mounting in the cylinder cover of larger cylinders is likewise possible.

The main control piston of the valve according to the invention is mounted for axial displacement in the control sleeve. One of the two end faces of the main control piston is axially opposite the fourth axial working port. The second end face of the main control piston forms a pressure-equalizing surface of the piston acting hydrostatically against the first piston end surface in a spring chamber in extension of the control sleeve. The spring chamber is connected hydraulically by a pressure-relief duct in the main control piston to the fourth main-stream port. This pressure-relief duct likewise connects an auxiliary port chamber to the fourth main-stream port. A return spring is clamped in the spring chamber and in engagement with the main control piston (e.g. via spring plates). This return spring opposes the hydraulic actuating force in both the control chambers with a spring force proportional to the piston stroke in both directions and thus defines a pressure-centered center position for the main control piston in the case of pressureless control chambers. A pilot valve with a controller is connected hydraulically to the two control chambers. A position transducer for the main control piston supplies a feedback signal for the pilot valve controller.

In the valve according to the invention the asymmetrical, hydrostatic loading of the main control piston is compensated by suitable dimensioning of the pressure-equalizing surface of the main control piston. This hydrostatic compensation reduces the required actuating forces for the main control piston, with the result that the actuating surfaces in the control chambers can be smaller. Smaller control oil volumes thus result, i.e. shorter setting times are achieved with a pilot valve of the same size. Furthermore, the symmetrical, hydrostatic loading of the main control piston enables a problem-free use of a one-sided return spring for the spring centering of the main control piston. It should also be noted that the center position of the main control piston is reliably fixed by the direct mechanical action of the return spring on the main control piston.

The servo valve ports are preferably assigned as follows:

a) the first main-stream port is fluidically coupled to a first displacement chamber of a consumer and thus forms a first working port (A);

b) the second main-stream port is fluidically coupled to a tank and thus forms a tank port (T);

c) the third main-stream port is fluidically coupled to a second displacement chamber of a consumer and thus forms a second working port (B);

d) the fourth main main-stream port is fluidically coupled to a pump and thus forms a pump port (P).

In this design the pump port (P) can be connected axially into the control sleeve, whereas the tank port (T) is located between the first and second working port. However, other assignments of the main-stream ports are also possible without having to sacrifice the most important advantages of the servo valve according to the invention.

It should also be noted that generally a pump is a hydraulic pressure source, a tank is a vessel or line without significant counter-pressure, and a consumer is a hydraulic consumer with two displacement chambers (e.g. a rotary or linear drive).

In a preferred embodiment of the servo valve the control edges assume the following position with a spring-centered center position of the main control piston:

a) the first axial hydraulic connection is closed by the first control edge, b) the second axial hydraulic connection is open, c) the third axial hydraulic connection is open, d) the fourth axial hydraulic connection is closed by the fourth control edge.

The working ports (A) and (B) are thus connected to the tank port (T) when the main control piston is in the spring-centered center position. In other words the two displacement chambers of a connected consumer are both pressure-relieved when the main control piston is in the spring-centered center position. In this design the four control edges of the main control piston preferably have zero-overlapping. This zero-overlapping provides excellent positioning accuracy, when the valve is used in a position control circuit of a hydraulic cylinder, and excellent dynamic properties, when the valve is used for pressure control. However, other arrangements of the control edges are also possible. For example, all ports could be closed by the control edges when the main control piston is in the spring-centered center position.

The spring centering is preferably designed as follows. The main control piston has an axial extension shaft in the spring chamber. A first and second spring plate are mounted for axial displacement on this extension shaft. When the valve is in its rest position, the return spring urges the first spring plate against a stop means on the main control piston and the second spring plate against a stop means on the free end of the extension piston. The spring chamber is dimensioned in such a way that in this rest position both spring plates abut axially in the spring chamber.

DETAILED DESCRIPTION

Figure 1:
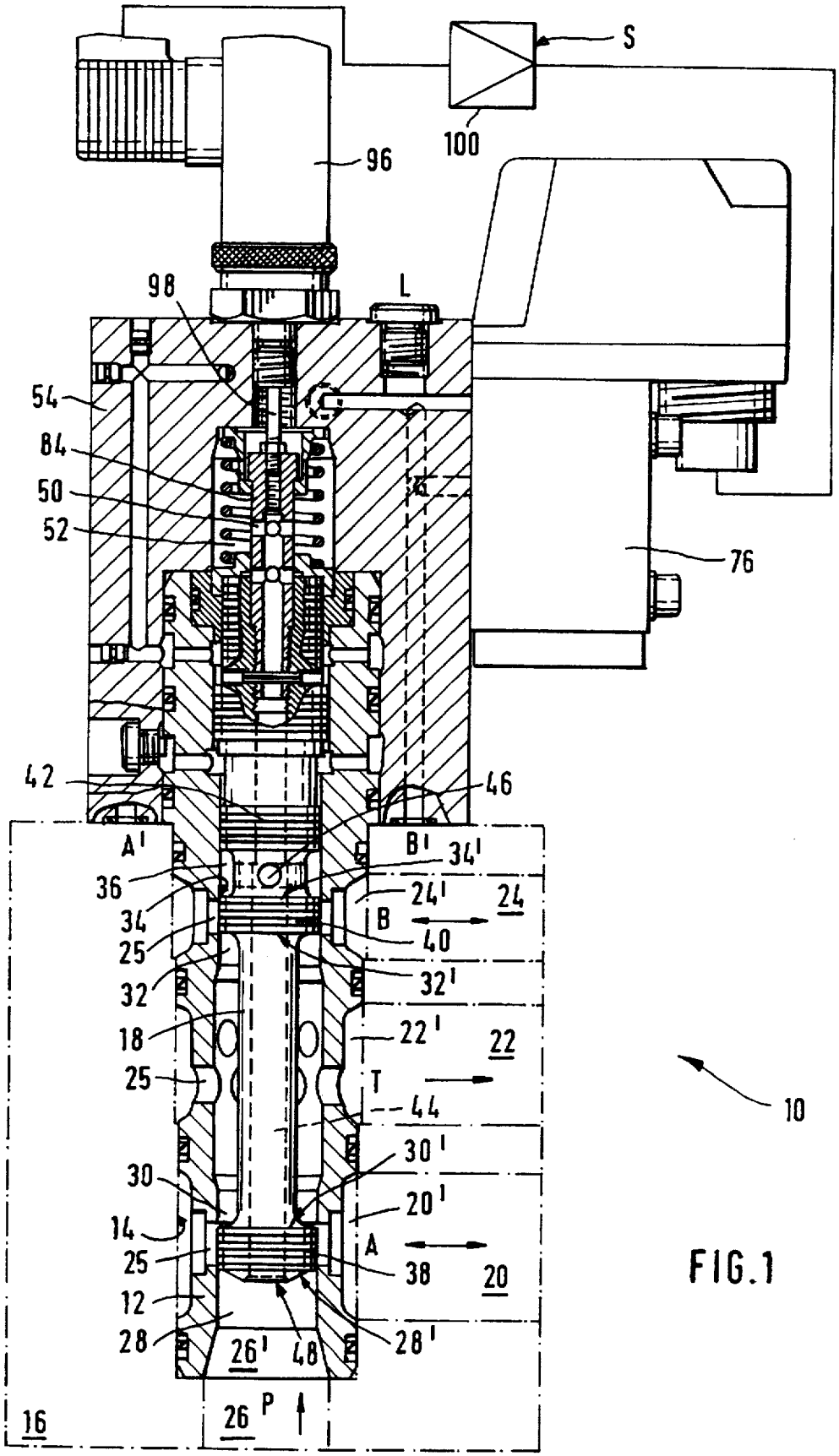
FIG. 1 shows a longitudinal sectional view of a servo valve constructed in accordance with the principles of the present invention.

In FIG. 1 the servo valve according to the invention is designated as such with reference number 10. A control sleeve 12 is inserted in a stepped bore 14 of a (merely indicated) hydraulic block 16. The control sleeve 12 forms an axial guide bore, in which a main control piston 18 is axially displaceable.

The servo valve 10 shown in the figures is a 4-way servo valve and has a pump port (P), a tank port (T), a first working port (A) and a second working port (B). The pump port (P) is hydraulically connected to a pressure line (not shown). The tank port (T) is hydraulically connected to a pressure-less line (not shown). The working ports (A and B) are hydraulically connected respectively to a first and second displacement chamber of a hydraulic linear or rotary drive (not shown).

Three block bores 22, 20, 24 in the hydraulic block 16 for the tank port (T) 22, the first working port (A) 20 and the second working port (B) 24 are arranged at right angles to the stepped bore 14 and terminate laterally in the stepped bore 14. In the stepped bore 14 the control sleeve 12 has annular openings 22', 20', 24' in the area of the corresponding block bores 22, 20, 24. Each of these openings 22', 20', 24' has several transverse bores 25 through the wall of control sleeve 12, each of which establishes a hydraulic connection to the guide bore of the main control piston 18. A fourth block bore 26 for a pump port (P) is arranged in a coaxial extension of the stepped bore 14. The control sleeve 12 has a front opening 26' for this fourth block bore 26.

Within the control sleeve 12 a first axial hydraulic connection 28 connects the front opening 26' for the pump port (P) to the lateral opening 20' for the working port (A), a second axial hydraulic connection 30 connects the opening 22' for the tank port (T) to the opening 20' for the working port (A), a third axial hydraulic connection 32 connects the opening 22' for the tank port (T) to the opening 24' for the working port (B), and a fourth axial hydraulic connection 34 connects the opening 24' for the working port (B) with an auxiliary chamber 36 delimited within the control sleeve 12 by the main control piston 18. Due to the arrangement of the annular openings 22', 20', 24' the axial distance between the second and third (30 and 32) axial hydraulic connections is far greater than the axial distance between the first and second (28 and 30) or third and fourth (32 and 34) axial hydraulic connections respectively.

The main control piston 18 has a first coaxial piston collar 38, which is assigned to working port (A) and is displaceable axially in the first and second axial hydraulic connections 28 and 30, and also a second coaxial piston collar 40, which is assigned to working part (B) and is displaceable axially in the third and fourth axial hydraulic connections 32 and 34. The first piston collar 38 forms a first control edge 28' that is assigned to the first hydraulic connection 28 and a second control edge 30' that is assigned to the second hydraulic connection 30. Both control edges 28', 30' have zero overlapping. The second piston collar 40 forms a third control edge 32' that is assigned to the third hydraulic connection 32, and a fourth control edge 34' that is assigned to the fourth hydraulic connection 34. Both control edges 32', 34' likewise have zero overlapping. The auxiliary port chamber 36 forms an annular enclosure around the main control piston 18 in the control sleeve. It is axially sealed on one side by the piston collar 40 and on the other side by a piston collar 42.

The auxiliary port chamber 36 is connected to the pump port (P) via an axial piston bore 44 and a piston cross-bore 46 through the main control piston 18. The main control piston can accordingly selectively connect the first working port (A) via its coaxial piston collar 38 and the second working port (B) via its coaxial piston collar 40 to the pump port (P) or the tank port (T), the respective through-flow of the hydraulic fluid being regulated by the four control edges 28', 30', 32', 34'.

The pressure on the piston end surface 48 applies an asymmetrical hydrostatic load on the main control piston 18. To equalize the hydrostatic forces on the main control piston the coaxial piston bore 44 is extended to the second end of the main control piston 18, where it terminates in a pressure-equalizing or spring chamber 52 via a piston cross-bore 50. This upper part of the valve is described in more detail with reference to the enlarged section in FIG. 2.

The spring chamber 52 is arranged in a valve cover 54 in axial extension of the control sleeve 12. This valve cover 54 is mounted on the hydraulic block 16 and fixes the control sleeve 12 in the stepped bore 14. The second end of the main control piston 18 is axially sealed by an insert 56 and is introduced into the spring chamber 52, forming therein a pressure equalizing protrusion 58. The latter has a pressure equalizing surface 60, which hydrostatically opposes the first piston end surface 48, in the pressure-equalizing chamber 52. The pressure-equalizing surface 60 is preferably equal in area to the piston end surface 48, so that full hydrostatic pressure equalization of the pump pressure results.

The main control piston 18 is actuated via a coaxial actuating piston collar 62 affixed to it, by application of appropriate pressure on its annular first or second actuating surface 64, 66. A first annular control chamber 68 is formed in the control sleeve between piston collar 42 and actuating surface 64 and a second annular control chamber 68 between sealing insert 56 and actuating surface 66. The first control chamber 68 is connected via a pilot port 72 in the valve cover 54 to working port (A'), and the second control chamber 70 is connected via a pilot port 74 in the valve cover 54 to working port (B') of a flange-mounted 4-way pilot servo valve 76. The dimensions of actuating surfaces 64, 66 are selected so that the flow forces generated when the control edges 28', 32' or 30', 34' are overflowed are reliably overcome. Consequently the control oil volumes are extremely small and very short correction times can be achieved.

Figure 2:
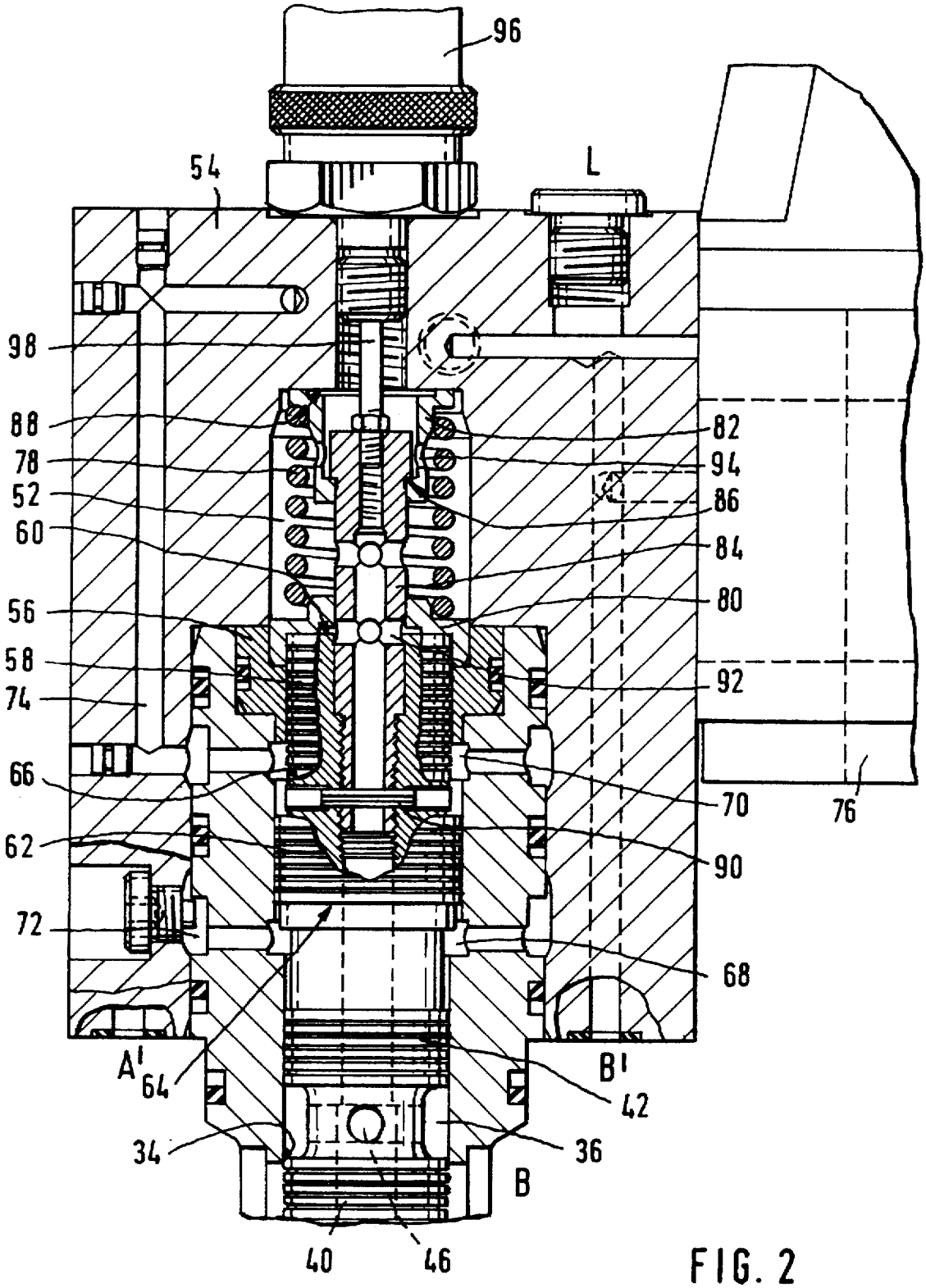
FIG. 2 shows an enlarged detail of FIG. 1.

In the spring chamber 52 a return spring 78 is clamped axially between a first and second spring plate 80 and 82. An extension shaft 84 is connected rigidly to the second end of the main control piston 18. The spring plates 80 and 82 are axially displaceable on this shaft 84. The shaft 84 has an axial stop surface 86 for the second spring plate 82 at its free end. The second piston end surface 60 forms an axial stop surface for the first spring plate 80. In FIG. 2 the return spring 78 forces the first spring plate 80 against the stop surface 60 and the second spring plate 82 against the stop surface 86. In this position the first spring plate 80 is likewise in contact with the housing at the sealing insert 56 and the second spring plate 82 in contact with the housing at an axially opposite stop surface 88 of the valve cover 54. Both spring plates 80 and 82 are accordingly in contact with the housing and the main control piston 18 is clamped via the extension shaft 84 between the two spring plates 80 and 82, which are spring-loaded in opposite directions by the return spring 78. In other words, the main control piston 18 is in a spring-centered rest position, which is also designated as the center position.

If the main control piston 18 is moved by admission of pressure to the first control chamber 68 from its center position towards the spring chamber 52, the return spring 78 is compressed by the first spring plate 80 in the spring chamber 52, which abuts against the end 60 of the main control piston 18. It thus exerts on the main control piston 18 a spring force which opposes this movement and the modulus of which is proportional to the stroke of the main control piston 18. If the main control piston 18 is moved by admission of pressure to the second control chamber 70 from its center position towards pump port 26, the extension shaft 84 exerts a tensile force on the second spring plate, so that the return spring 78 is now compressed by the second spring plate 82 in the spring chamber 52. This spring force acts against the movement of the main control piston 18, and its modulus is proportional to the stroke of the main control piston 18. Use of a single return spring 78, which operates as a compression spring for both lifting directions, ensures that the main control piston 18 is exposed to exactly the same restoring force in both directions.

It is clear from the partial section in FIG. 2 that the extension shaft 84 is screwed into the main control piston and secured by a pin 90. The axial piston bore 44 is extended in the extension shaft 84 as far as the cross bore 46. A further cross bore 92 is located immediately above the end surface 60 of the main control piston 18. The purpose of this second cross bore 92 is to ensure pressure equalization above and below the spring plate 80. In the case of the second spring plate 82 this pressure equalization is achieved by holes 94 in the spring plate 82.

As shown in FIG. 1, the main control piston is integrated in a closed position control circuit via a position transducer 96. A shaft 98 of the position transducer 96 is connected mechanically to the extension shaft 84 of the main control piston. The output signal of the position transducer 96 (which corresponds to the position of the main control piston 18) is compared with a required value (S) in a control amplifier 100, and the pilot servo valve 76 is actuated in proportion to the determined difference between the required and actual values. The pilot servo valve 76 then regulates the control oil pressure in both control chambers 68 and 70 of the main stage and fixes the piston stroke against the effect of the return spring 78, so that a closed electrohydraulic control circuit is formed.

FIG. 1 also shows the main control piston 18 in a spring-centered rest or center position. The control edges 28', 30', 32', 34' are arranged on the main control piston 18 in such a way that in this center position:

- the first control edge 28' closes the first hydraulic connection 28 between pump port (P) and working port (A);
- the second control edge 30' opens the second hydraulic connection 30 between tank port (T) and working port (A);
- the third control edge 32' opens the third hydraulic connection 30 between tank port (T) and working port (B);
- the fourth control edge 34' closes the fourth hydraulic connection between working port (B) and the auxiliary port chamber 36 and thus eliminates the hydraulic connection via the axial piston bore 44 between working port (B) and pump port (P).

In this spring-centered center position the working ports (A) and (B) are thus relieved pressureless to the tank. If the main control piston 18 is moved from this center position towards pump port (P), the working port (A) remains relieved to the tank. However, working port (B) is connected hydraulically via the auxiliary port chamber 36 and the axial piston bore 44 to the pump port (P). If, on the other hand, the main control piston 18 is moved from this center position towards the spring chamber 52, the working port (B) remains relieved to the tank. However, the working port (A) is closed to the tank by the second control edge 30' and connected hydraulically to pump port (P) via the first control edge 32'. If the control pressure fails, the main control piston 18 assumes its spring-centered center position, in which both working ports (A) and (B) are relieved to the tank, as described above.

What is claimed is:

1. A pilot-operated servo valve comprising:

a) a valve housing including:

a control sleeve; first, second, third and fourth axially spaced main stream port openings through said control sleeve, each of said main stream port openings corresponding to a respective main stream port;

an axial piston guide bore in said control sleeve;

a first hydraulic connection within said control sleeve between said fourth and first main-stream ports;

a second hydraulic connection within said control sleeve between said first and second main-stream ports;

a third hydraulic connection within said control sleeve between said second and third main-stream ports;

an auxiliary port chamber;

a fourth hydraulic connection within said control sleeve between said third main-stream port and an auxiliary port chamber; and a spring chamber;

b) a main control piston disposed for axial displacement within said guide bore of said control sleeve, said main control piston having:

a first end having a first piston end surface formed thereon, said fourth main stream port opening being disposed opposite said first piston end surface and said first, second and third main stream port openings being disposed sideways from said main control piston;

a second end;

a first control edge disposed to control flow through said first hydraulic connection;

a second control edge disposed to control flow through said second axial hydraulic connection;

a third control edge disposed to control flow through said third axial hydraulic connection, a fourth control edge disposed to control flow through said fourth axial hydraulic connection;

a pressure-equalizing surface formed by said second end of said main control piston in said spring chamber;

a pressure-relief duct hydraulically connecting said spring chamber to said fourth main-stream port through said main control piston, so that said pressure equalizing surface is loaded with said pressure in said fourth main-stream port, and a cross-bore hydraulically connecting said pressure-relief duct to said auxiliary port chamber;

said main control piston delimiting a first and second control chamber within said valve housing and having within said first control chamber a first actuating surface and within said second control chamber a second actuating surface axially opposing said first actuating surface;

c) a return spring which is clamped in said spring chamber and engages with said main control piston so as to define a spring-centered center position of said main control piston;

d) a pilot valve which is fluidically coupled to at least one of said first and second control chambers;

e) a controller for said pilot valve;

f) a position transducer which is connected to said main control piston and supplies said position of said main control piston as a feedback signal for said controller of said pilot valve.

2. The valve of claim 1, wherein:

said first main-stream port is fluidically coupled to a first displacement chamber of a consumer, thereby constituting a first working port, said second main-stream port is fluidically coupled to a tank, thereby constituting a tank port, said third main-stream port is fluidically coupled to a second displacement chamber of a consumer, thereby constituting a second working port, and said fourth main-stream port is fluidically coupled to a pump, thereby constituting a pump port.

3. The valve of claim 1, wherein said control edges are arranged in such a way on said main control piston that they assume the following positions when said main control piston is in said spring-centered center position:

a) said first axial hydraulic connection is closed by said first control edge, b) said second axial hydraulic connection is open, c) said third axial hydraulic connection is open, and d) said fourth axial hydraulic connection is closed by said fourth control edge.

4. The valve of claim 1, wherein said first and second actuating surfaces are annular surfaces.

5. The valve of claim 1, comprising:

an axial extension shaft of said main control piston in said spring chamber, a first and second spring plate, which are mounted for axial displacement on said extension shaft, an axial stop surface on said main control piston for said first spring plate, an axial stop surface on said extension shaft for said second spring plate, said return spring forcing each of said two spring plates against its stop surface when said valve is in said rest position, and said spring chamber being dimensioned in such a way that in said rest position both spring plates abut axially in said spring chamber.

6. The valve of claim 5, wherein said pressure-relief duct is extended as an axial bore into said extension shaft, a first cross bore through said extension shaft connecting said axial bore to said spring chamber.

7. The valve of claim 6, wherein said extension shaft has a second cross-bore in the immediate vicinity of said first stop surface for said first spring plate.

* * * * *

UNITED STATES PATENT AND TRADEMARK OFFICE

CERTIFICATE OF CORRECTION

PATENT NO. : 5,896,890
DATED : Apr. 27, 1999
INVENTOR(S) : Bourkel et al.

It is certified that error appears in the above-identified patent and that said Letters Patent is hereby corrected as shown below:

On the title page, item (30) Foreign Application Priority Data, replace "Nov. 6, 1994" with --Nov. 16, 1994--

Signed and Sealed this
Sixteenth Day of November, 1999

*Attest:*

*Attesting Officer*

Q. TODD DICKINSON

*Acting Commissioner of Patents and Trademarks*